US005890878A

United States Patent [19]

Murase et al.

[11] Patent Number: 5,890,878

[45] Date of Patent: Apr. 6, 1999

[54] VALVE STRUCTURE IN COMPRESSOR

[75] Inventors: Masakazu Murase; Tetsuhiko Fukanuma; Eiji Tokunaga; Takuya Okuno, all of Kariya, Japan

[73] Assignee: Kabushiki Kaisha Toyoda Jidoshokki Seisakusho, Kariya, Japan

[21] Appl. No.: 812,596

[22] Filed: Mar. 7, 1997

[30] Foreign Application Priority Data

Mar. 19, 1996 [JP] Japan ..... 8-063095

[51] Int. Cl.[6] ..... F04B 39/10

[52] U.S. Cl. ..... 417/222.2; 417/269; 417/569; 137/855

[58] Field of Search ..... 417/222.2, 269, 417/571, 569, 566; 137/855, 516.11

[56] References Cited

U.S. PATENT DOCUMENTS

| | | | |
|---|---|---|---|
| 4,325,680 | 4/1982 | Bar | 417/569 |
| 5,044,892 | 9/1991 | Pettitt | 417/269 |
| 5,143,027 | 9/1992 | Bergeron | 137/855 |
| 5,226,796 | 7/1993 | Okamoto et al. | 417/571 |
| 5,616,008 | 4/1997 | Yokono et al. | 417/222.2 |
| 5,636,973 | 6/1997 | Sonobe et al. | 417/222.2 |
| 5,672,053 | 9/1997 | Sabha | 417/569 |
| 5,713,725 | 2/1998 | Kawaguchi et al. | 417/222.2 |
| 5,741,122 | 4/1998 | Yokono et al. | 417/222.2 |

FOREIGN PATENT DOCUMENTS

| | | |
|---|---|---|
| 0077895 | 5/1983 | European Pat. Off. . |
| 8912758 | 1/1990 | Germany . |
| 4110647 | 10/1991 | Germany . |
| 4302256 | 8/1993 | Germany . |

*Primary Examiner*—Charles G. Freay
*Attorney, Agent, or Firm*—Morgan & Finnegan, L.L.P.

[57] ABSTRACT

A compressor comprises a plurality of compression chambers used for compressing gas. A gas chamber includes one of a suction chamber for supplying the gas to the compression chambers and a discharge chamber for receiving the compressed gas from the compression chambers. A plate member is located between the compression chambers and the gas chamber. The plate member has a plurality of ports respectively arranged in association with the compression chambers for connecting each compression chamber with the gas chamber. A plurality of valve flaps are respectively arranged in association with the ports. Each of the valve flaps faces the plate member to selectively open and close the associated port. Each valve flap has a proximal end supported on the plate member. The plate member has at least one groove formed thereon and facing the proximal end of each valve flap. Foreign matter enters between the proximal end of each valve flap and the plate member and is collected by the groove. The groove extends over at least two valve flaps.

28 Claims, 10 Drawing Sheets

VALVE STRUCTURE IN COMPRESSOR

BACKGROUND OF THE INVENTION

1. Field of the Invention

The present invention relates to the structure of valve incorporated in compressors that are used in vehicle air conditioners. More particularly, the present invention relates to a technique for improving the sealing between a valve flap and the corresponding valve seat in compressors. The valve flaps are used to selectively open and close ports for permitting gas flow from a suction chamber to a compression chamber or from a compression chamber to a discharge chamber. The valve flap contacts the valve seat for closing the port.

2. Description of the Related Art

Piston type compressors typically have a valve plate located between compression chambers in the cylinder bores and suction and discharge chambers. A valve plate includes suction ports and discharge ports. The suction ports communicate the compression chambers with the suction chamber and the discharge ports communicate the compression chambers with the discharge chamber. A suction valve flap is arranged opposed to each suction port for selectively opening and closing the port. A discharge valve flap is arranged opposed to each discharge port for selectively opening and closing the port. A valve seat is formed about each port on the valve plate. Contact between a valve flap and the associated valve seat closes the port.

As each piston moves from the top dead center to the bottom dead center in the associated cylinder bore, refrigerant gas in the suction chamber is drawn into the compression chamber through the associated suction port and the associated suction valve flap. As each piston moves from the bottom dead center to the top dead center in the associated cylinder bore, refrigerant gas is compressed in the compression chamber and discharged to the discharge chamber through the associated discharge port and the associated discharge valve flap.

During operation, sliding parts in a compressor such as the pistons and cylinder bores often abrade one another and generate metal powder. If caught between the proximal end of a valve flap and the valve plate, foreign matter such as the metal powder prevents the valve from closing the port. In other words, the foreign matter deteriorates the seal between a valve flap and the associated valve seat. A sealing defect in a suction valve flap causes the refrigerant gas in the corresponding compression chamber to leak into the suction chamber during the compression stroke. A sealing defect in a discharge valve flap causes the refrigerant gas in the discharge chamber to flow back to the corresponding compression chamber during the suction stroke. Such leaking and backflow of refrigerant gas significantly deteriorates the compression efficiency of the compressor.

Japanese Unexamined Patent Publications No. 3-37378 and No. 7-286581 disclose variable displacement compressors that control the discharge displacement of refrigerant gas by adjusting the inclination of a swash plate. In the compressors according to these publications, the above described sealing defects cause the following disadvantages.

Variable displacement compressors often have a drive shaft directly connected to an external drive source such as an engine without a clutch located in between. In such a clutchless system, the compressor is operated even if cooling is not necessary or when frost is being formed in an evaporator. In such a case, the circulation of refrigerant gas between the external refrigerant circuit and the compressor must be stopped. The compressors disclosed in Japanese Unexamined Patent Publications No. 3-37378 and No. 7-286581 stop the flow of refrigerant gas from the external refrigerant circuit into the suction chamber of the compressors, thereby stopping the circulation of the refrigerant gas.

In the compressors according to the above cited publications, the gas flow into the suction chamber from the external refrigerant circuit is stopped when the inclination of the swash plate is minimum. As the swash plate's inclination increases from the minimum, the refrigerant gas again starts flowing into the suction chamber from the external refrigerant circuit. When the swash plate's inclination increases from the minimum, that is, when the displacement of the compressor increases from the minimum displacement, an effective compression needs to be performed. Effective compression here refers to an operation in which refrigerant gas in the compression chamber is discharged to the discharge chamber without backflow of the gas from the discharge chamber to the compression chamber. The above described sealing defects between a discharge valve flap and its valve seat disturbs the effective compression. This affects the capability of the compressor to regain displacement.

SUMMARY OF THE INVENTION

Accordingly, it is an objective of the present invention to provide a valve structure that improves the sealing of a valve flap and its valve seat.

To achieve the above object, the compressor according to the present invention comprises a plurality of compression chambers for compressing gas, a gas chamber including one of a suction chamber for supplying the gas to the compression chambers and a discharge chamber for receiving the compressed gas from the compression chambers, and a plate member located between the compression chambers and the gas chamber. The plate member has a plurality of ports respectively arranged in association with the compression chambers for connecting each compression chamber with the gas chamber. A plurality of valve flaps are respectively arranged in association with the ports. Each of the valve flaps faces the plate member to selectively open and close the associated port. Each valve flap has a proximal end supported on the plate member. The plate member has groove means formed thereon and facing the proximal end of each valve flap. Foreign matter entering between the proximal end of each valve flap and the plate member is collected by the groove means. The groove means extends over at least two valve flaps.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor according to a first embodiment of the present invention will now be described with reference to FIGS. 1 to 5.

Figure 1:
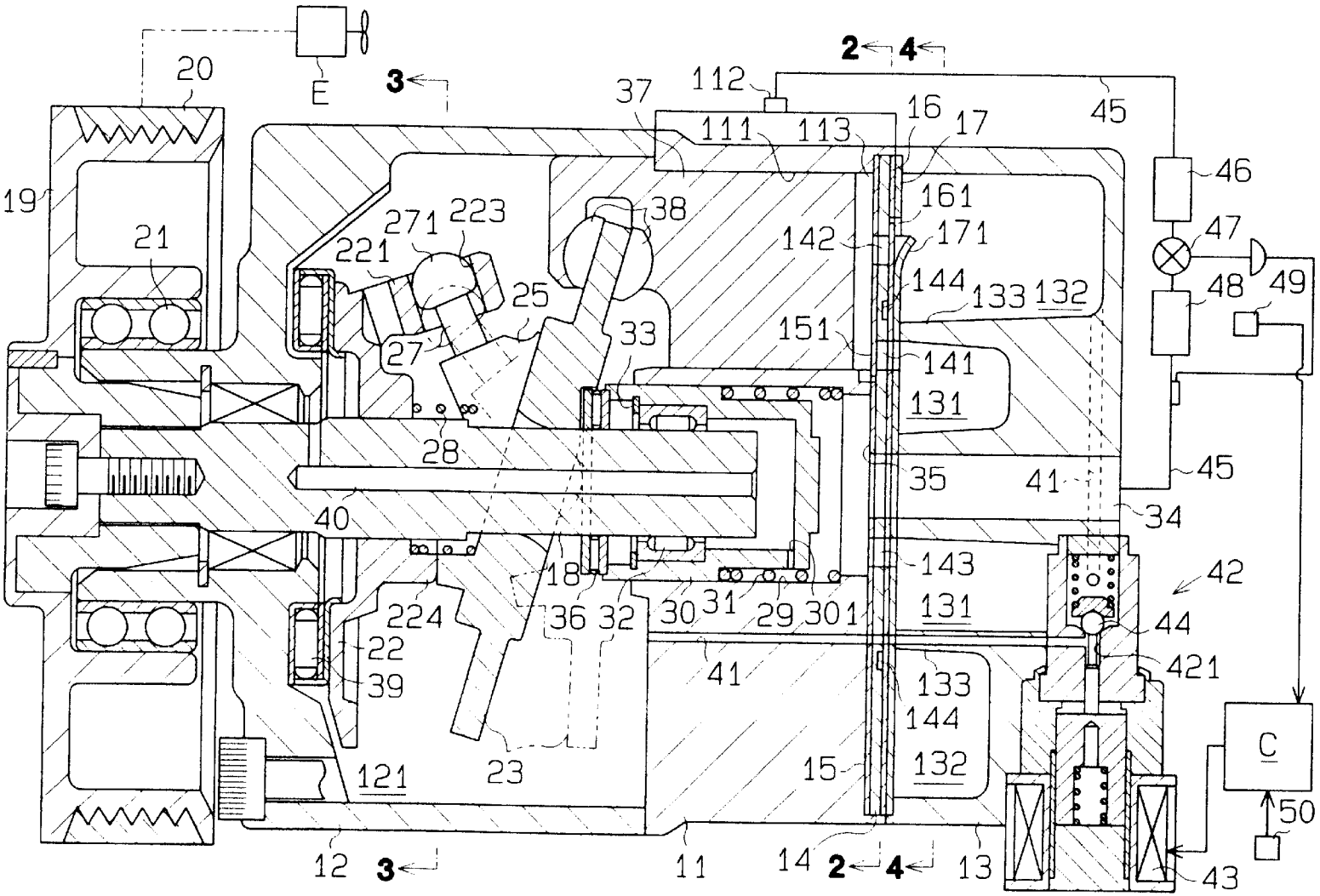
FIG. 1 is a cross-sectional side view illustrating a compressor according to a first embodiment of the present invention.

As shown in FIG. 1, a front housing 12 is secured to the front end face of a cylinder block 11. A rear housing 13 is secured to the rear end face of the cylinder block 11 with a valve plate 14, a first plate 15, a second plate 16 and a third plate 17 provided in between. A crank chamber 121 is defined by the inner walls of the front housing 12 and the front end face of the cylinder block 11.

A drive shaft 18 is rotatably supported in the front housing 12 and the cylinder block 11. The front end of the drive shaft 18 protrudes from the crank chamber 121 and is secured to a pulley 19. The pulley 19 is directly coupled to an external drive source (a vehicle engine E in this embodiment) by a belt 20. The compressor of FIG. 1 is a clutchless type variable displacement compressor having no clutch between the drive shaft 18 and the external drive source. The pulley 19 is supported by the front housing 12 with an angular bearing 21 located in between. The front housing 12 carries thrust and radial loads that act on the pulley 19 via the angular bearing 21.

Figure 3:
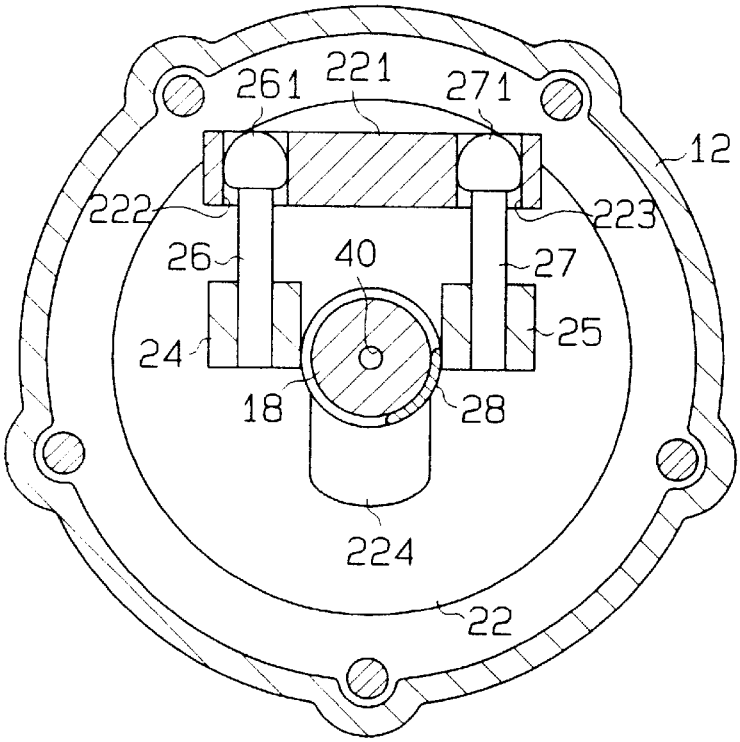
FIG. 3 is a cross-sectional view taken along line 3—3 of FIG. 1.

A substantially disk-like swash plate 23 is supported by the drive shaft 18 in the crank chamber 121 to be slidable along and tiltable with respect to the axis of the shaft 18. As shown in FIGS. 1 and 3, the swash plate 23 is provided with a pair of guiding pins 26, 27, each having a guide ball 261, 271 at the distal end. The guiding pins 26, 27 are fixed to the swash plate 23 by stays 24, 25, respectively. A rotor 22 is fixed to the drive shaft 18 in the crank chamber 121. The rotor 22 rotates integrally with the drive shaft 18. The rotor 22 has a support arm 221 protruding toward the swash plate 23. A pair of guide holes 222, 223 are formed in the support arm 221. Each guide ball 261, 271 is slidably fitted into the corresponding guide hole 222, 223. The cooperation of the arm 221 and the guide pins 26, 27 permits the swash plate 23 to rotate together with the drive shaft 18. The cooperation also guides the tilting of the swash plate 23 and the movement of the swash plate 23 along the axis of the drive shaft 18. As the swash plate 23 slides toward the cylinder block 11, or slides backward, the inclination of the swash plate 23 decreases.

A coil spring 28 is located between the rotor 22 and the swash plate 23. The spring 28 urges the swash plate 23 backward, or in a direction to decrease the inclination of the swash plate 23.

Figure 2:
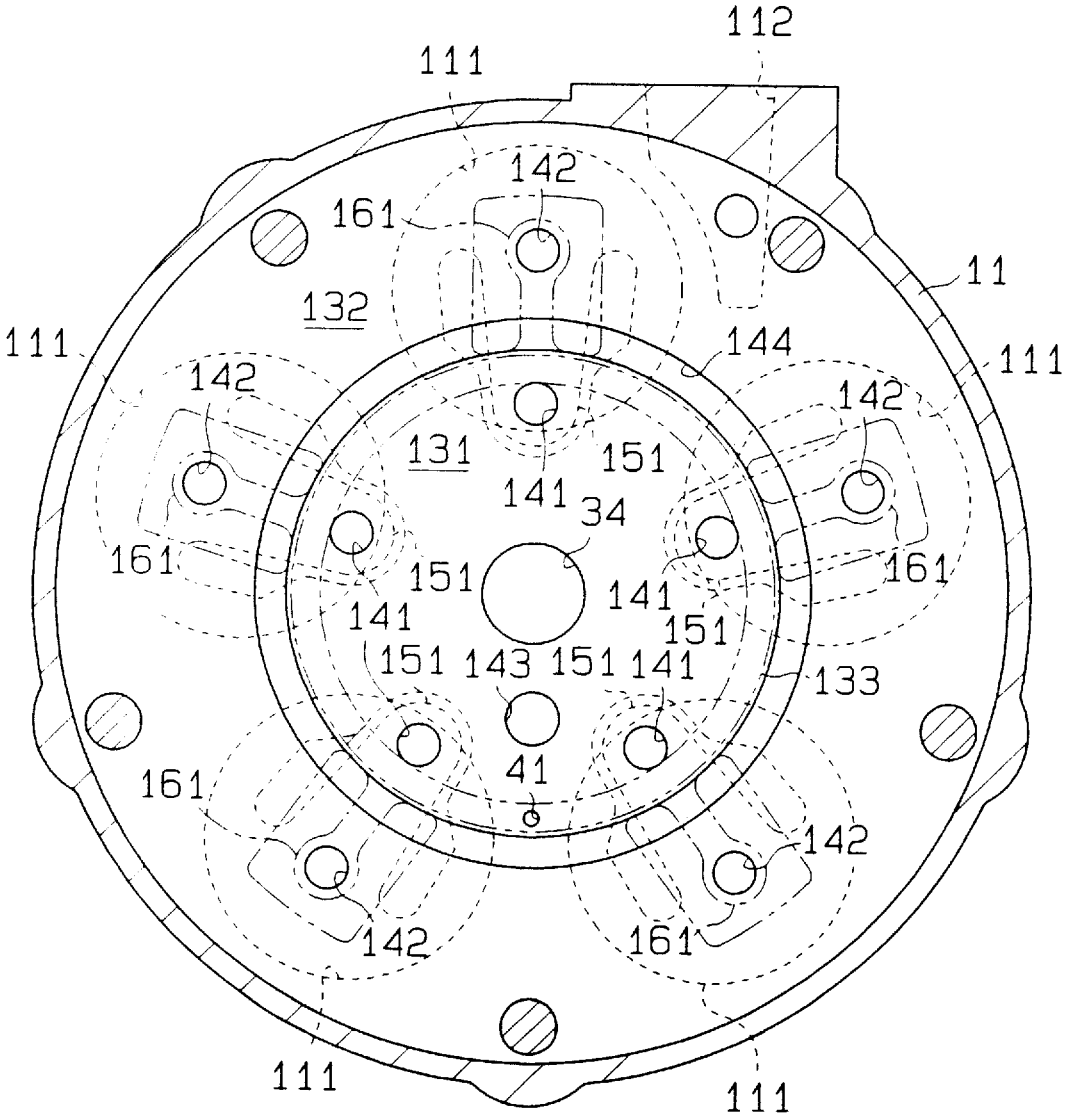
FIG. 2 is a cross-sectional view taken along line 2—2 of FIG. 1.
Figure 4:
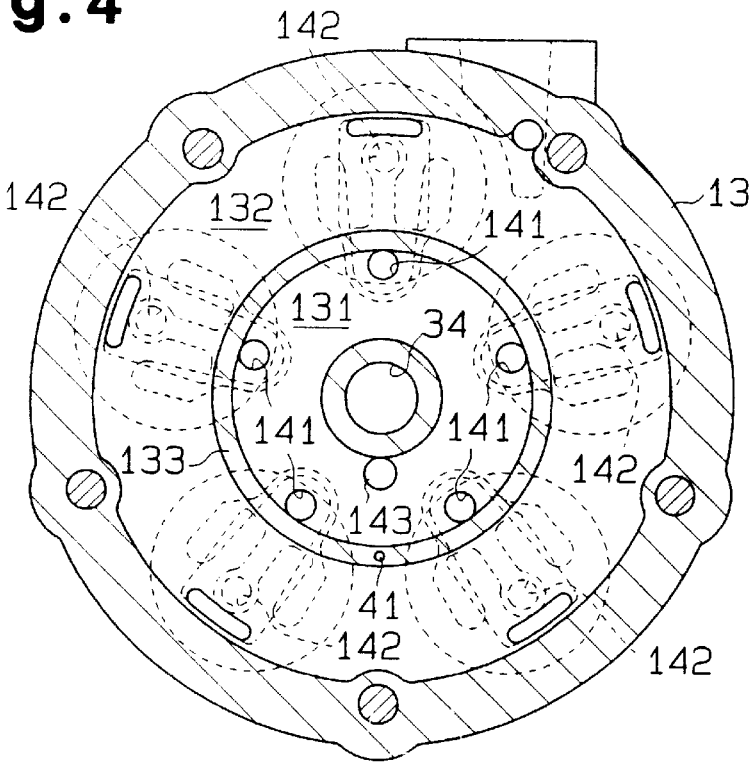
FIG. 4 is a cross-sectional view taken along line 4—4 of FIG. 1.

As shown in FIGS. 1, 2 and 4, a plurality of cylinder bores 111 extend through the cylinder block 11 and are located about the axis of the drive shaft 18. The cylinder bores 111 are spaced apart at equal intervals. A single-headed piston 37 is accommodated in each cylinder bore 111. A pair of hemispherical shoes 38 are fitted between each piston 37 and the swash plate 23. A hemispherical portion and a flat portion are defined on each shoe 38. The hemispherical portion slidably contacts the piston 37 while the flat portion slidably contacts the swash plate 23. The swash plate 23 rotates integrally with the drive shaft 18. The rotating movement of the swash plate 23 is transmitted to each piston 37 through the shoes 38 and converted to a linear reciprocating movement of each piston 37 in the associated cylinder bore 111. A compression chamber 113 is defined in each cylinder bore 111 between the head of the associated piston 37 and the valve plate 14.

As shown in FIGS. 1, 2 and 4, an annular suction chamber 131 is defined in the rear housing 13. An annular discharge chamber 132 is defined around the suction chamber 131 in the rear housing 13. A bulkhead 133 is formed in the rear housing 13 to divide the suction chamber 131 and the discharge chamber 132. The bulkhead 133 has an interior surface defining the discharge chamber 132. Suction ports 141 and discharge ports 142 are formed in the valve plate 14. Each suction port 141 and each discharge port 142 corresponds to one of the cylinder bores 111. Suction valve flaps 151 are formed on the first plate 15. Each suction valve flap 151 corresponds to one of the suction ports 141. Discharge valve flaps 161 are formed on the second plate 16. Each discharge valve flap 161 corresponds to one of the discharge ports 142. Part of the valve plate 14 around each port 141, 142 functions as a valve seat. Each valve flap 151, 161 contacts the corresponding valve seat to close the corresponding port 141, 142.

As each piston 37 moves from the top dead center to the bottom dead center in the associated cylinder bore 111, refrigerant gas in the suction chamber 131 is drawn into the compression chamber 113 through the associated suction port 141 and the associated suction valve 151. As each piston 37 moves from the bottom dead center to the top dead center in the associated cylinder bore 111, its suction valve flap 151 is forced closed and refrigerant gas is compressed in the compression chamber 113 and discharged to the discharge chamber 132 through the associated discharge port 142, and the associated discharge valve flap 161 is fixed open. Retainers 171 are formed on the third plate 17. Each retainer 171 corresponds to one of the discharge valve flaps 161. The opening amount of each discharge valve flap 161 is defined by contact between the valve flap 161 and the associated retainer 171.

Figure 5:
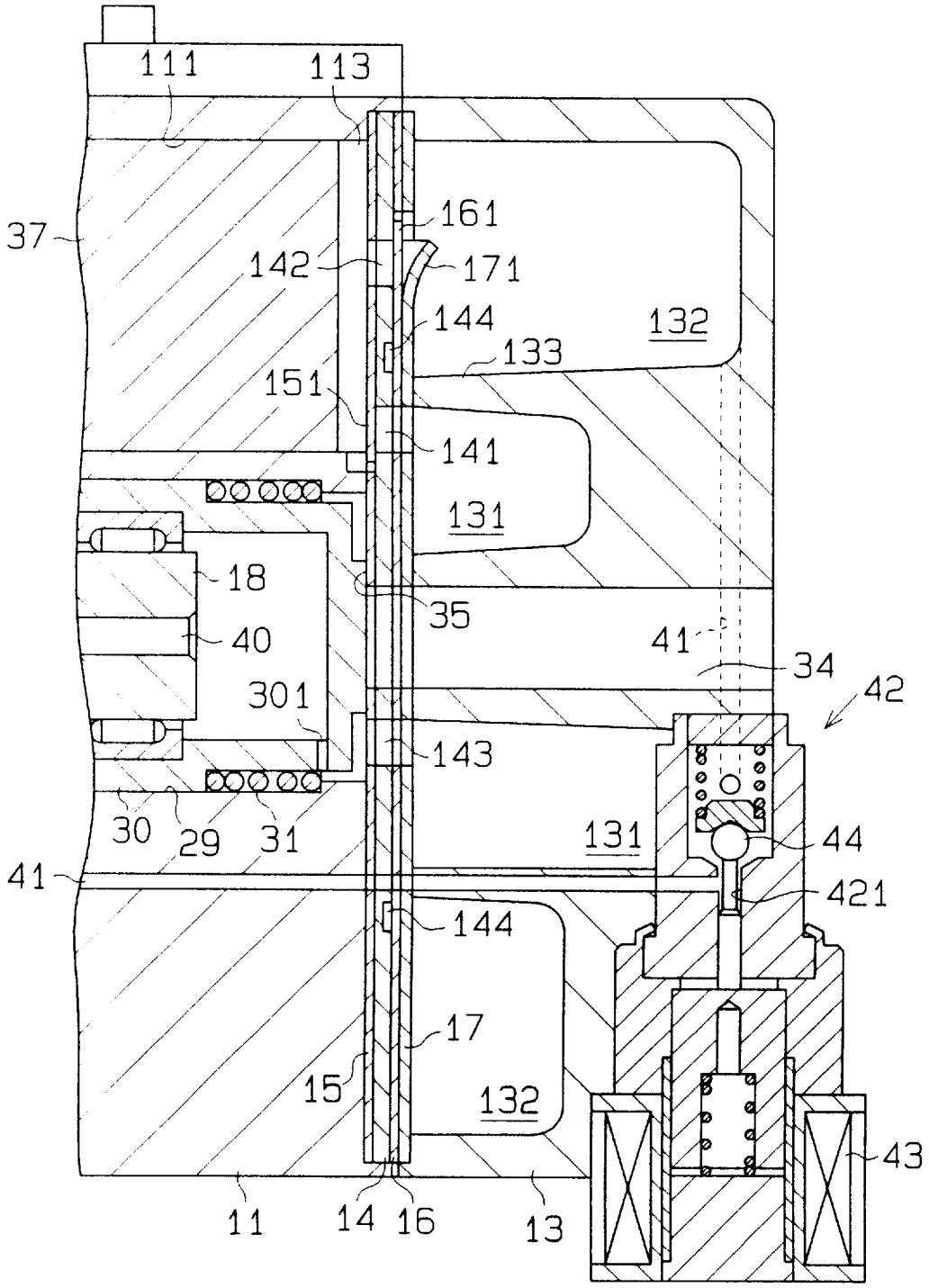
FIG. 5 is an enlarged partial cross-sectional side view illustrating a compressor operating with the minimum inclination of the swash plate.

As shown in FIGS. 1 and 2, an annular groove 144 is formed on the valve plate 14 facing the discharge valve flaps 161. The groove 144 faces the proximal end of each discharge valve flap 161. That is, the groove 144 extends circumferentially near the radially inward or proximal end of each discharge valve flap 161. The groove 144 has a proximal wall adjacent to the proximal end of the valve flap 161 and a distal wall, which is between the proximal wall and the associated port 142. As shown in FIGS. 2 and 5, the bulkhead 133 holds the second and third plates 16, 17 against the valve plate 14. The groove 144 is formed radially offset from the bulkhead 133. In other words, the groove 144 is not axially aligned with the bulkhead 133. However, the groove 144 is located radially adjacent to the bulkhead 133 such that the proximal wall of the groove 144 is substantially aligned with an interior surface of the bulkhead 133.

As shown in FIG. 1, a thrust bearing 39 is located between the front housing 12 and the rotor 22. The thrust bearing 39 carries the reactive force of gas compression acting on the rotor 22 through the pistons 37 and the swash plate 23.

As shown in FIGS. 1 and 5, a shutter chamber 29 is defined at the center portion of the cylinder block 11 extending along the axis of the drive shaft 18. The shutter chamber 29 is communicated with the suction chamber 131 by a communication hole 143. A hollow cylindrical shutter 30 is accommodated in the shutter chamber 29. The shutter 30 slides along the axis of the drive shaft 18. A coil spring 31 is located between the shutter 30 and a wall of the shutter chamber 29. The coil spring 31 urges the shutter 30 toward the swash plate 23.

The rear end of the drive shaft 18 is inserted in the shutter 30. The radial bearing 32 is fixed to the inner wall of the shutter 30 by a snap ring 33. Therefore, the radial bearing 32 moves with the shutter 30 along the axis of the drive shaft 18. The rear end of the drive shaft 18 is supported by the inner wall of the shutter chamber 29 with the radial bearing 32 and the shutter 30 in between.

A suction passage 34 is defined at the center portion of the rear housing 13 and the plates 14 to 17. The passage 34 extends along the axis of the drive shaft 18 and is communicated with the shutter chamber 29. A positioning surface 35 is formed on the first plate 15 about the inner opening of the suction passage 34. The rear end of the shutter 30 abuts against the positioning surface 35. Abutment of the shutter 30 against the positioning surface 35 prevents the shutter 30 from further moving backward away from the swash plate 23. The abutment disconnects the suction passage 34 from the shutter chamber 29.

A thrust bearing 36 is supported on the drive shaft 18 and is located between the swash plate 23 and the shutter 30. The thrust bearing 36 slides along the axis of the drive shaft 18. The force of the coil spring 31 constantly retains the thrust bearing 36 between the swash plate 23 and the shutter 30. The thrust bearing 36 prevents the rotation of the swash plate 23 from being transmitted to the shutter 30.

The swash plate 23 moves backward as its inclination decreases. As it moves backward, the swash plate 23 pushes the shutter 30 backward through the thrust bearing 36. Accordingly, the shutter 30 moves toward the positioning surface 35 against the force of the coil spring 31. As shown in FIG. 5, when the swash plate 23 reaches the minimum inclination, the rear end of the shutter 30 abuts against the positioning surface 35. In this state, the shutter 30 is located at the closed position for disconnecting the shutter chamber 29 from the suction passage 34.

A pressure release passage 40 is defined at the center portion of the drive shaft 18. The pressure release passage 40 communicates the crank chamber 121 with the interior of the shutter 30. A pressure release hole 301 is formed in the peripheral wall near the rear end of the shutter 30. The hole 301 communicates the interior of the shutter 30 with the shutter chamber 29.

As shown in FIGS. 1 and 5, a supply passage 41 is defined in the rear housing 13, the plates 14 to 17 and the cylinder block 11. The supply passage 41 communicates the discharge chamber 132 with the crank chamber 121. An electromagnetic valve 42 is accommodated in the rear housing 13 midway in the supply passage 41. The electromagnetic valve 42 has a valve body 44 and a solenoid 43. The valve body 44 is moved by the solenoid 43 to selectively open and close a valve hole 421.

When the solenoid 43 is excited, the valve body 44 closes the valve hole 421 as shown in FIG. 1. When the solenoid 43 is de-excited, the valve body 44 opens the valve hole 421 as shown in FIG. 5. That is, the electromagnetic valve 42 selectively opens and closes the supply passage 41, which communicates the discharge chamber 132 with the crank chamber 121.

An outlet port 112 is defined in the cylinder block 11 and is communicated with the discharge chamber 132. An external refrigerant circuit 45 connects the outlet port 112 with the suction passage 34. The external refrigerant circuit 45 includes a condenser 46, an expansion valve 47 and an evaporator 48. The expansion valve 47 controls the flow rate of refrigerant based on temperature fluctuations of refrigerant gas at the outlet of the evaporator 48. A temperature sensor 49 is located in the vicinity of the evaporator 48. The temperature sensor 49 detects the temperature of the evaporator 48 and issues signals relating to the detected temperature to a computer C. The computer C is connected to a switch 50 that activates the refrigerant apparatus.

The computer C controls the solenoid 43 in the electromagnetic valve 42 based on the signals from the sensor 49. Specifically, when the switch 50 is turned on, the computer C excites the solenoid 43 if the temperature detected by the temperature sensor 49 is equal to or higher than a predetermined temperature. This closes the valve hole 421, thereby preventing frost in the evaporator 48. When the switch 50 is turned off, the computer C de-excites the solenoid 43 to open the valve hole 421.

FIG. 1 shows a state in which the solenoid 43 in the valve 42 is excited and the valve hole 421 is closed by the valve body 44. Accordingly, the supply passage 41 is closed. The highly pressurized refrigerant gas in the discharge chamber 132 is not supplied to the crank chamber 121. The refrigerant gas in the crank chamber 121 enters the suction chamber 131 through the pressure release passage 40 and the pressure release hole 301. The pressure in the crank chamber 121 approaches the low pressure in the suction chamber 131, that is, the suction pressure. This decreases the difference between the pressure in the crank chamber 121 and the pressure in the compression chambers 113. The inclination of the swash plate 23 is thus maximum and the compressor operates at the maximum displacement. Abutment of the swash plate 23 against a protrusion 224 formed on the rotor 22 prevents further inclination of the swash plate 23 beyond the maximum inclination.

When the compressor is operating with the swash plate's inclination being maximum, a decrease in the cooling load causes the temperature of the evaporator 48 to gradually drop. When the evaporator's temperature is equal to or below the frost forming temperature, the computer C de-excites the solenoid 43 based on signals from the temperature sensor 49. De-exciting the solenoid 43 causes the valve body 44 to open the valve hole 421 as shown in FIG. 5. This supplies the highly pressurized refrigerant gas in the discharge chamber 132 to the crank chamber 121 through the supply passage 41, thereby increasing the pressure in the crank chamber 121. The difference between the pressure in the crank chamber 121 and the pressure in the compression chambers 113 is thus enlarged. This tilts the swash plate 23 from the maximum inclination to the minimum inclination. The compressor thus operates at the minimum displacement. Turning the switch 50 off also de-excites the solenoid 43, thereby moving the swash plate 23 to the minimum inclination.

When the inclination of the swash plate 23 is minimum, the shutter 30 abuts against the positioning surface 35. The abutment of the shutter 30 against the positioning surface 35 disconnects the suction passage 34 from the suction chamber 131. The shutter 30 slides in accordance with the tilting motion of the swash plate 23. Therefore, as the inclination of the swash plate 23 decreases, the shutter 30 gradually reduces the cross-sectional area of the passage between the suction passage 34 and the suction chamber 131. This gradually reduces the amount of refrigerant gas that enters the suction chamber 131 from the suction passage 34. The amount of refrigerant gas that is drawn into the compression chambers 113 from the suction chamber 131 gradually decreases, accordingly. As a result, the displacement of the compressor gradually decreases. This gradually lowers the discharge pressure of the compressor. The load torque of the compressor gradually decreases, accordingly. In this manner, the load torque for operating the compressor does not change significantly in a short time. The shock that accompanies load torque fluctuations is therefore lessened.

As shown in FIG. 5, the abutment of the shutter 30 against the positioning surface 35 prevents the inclination of the swash plate 23 from being smaller than the predetermined minimum inclination. The abutment also disconnects the suction passage 34 from the suction chamber 131. This stops the gas flow from the external refrigerant circuit 45 to the suction chamber 131, thereby stopping the circulation of refrigerant gas between the circuit 45 and the compressor.

The minimum inclination of the swash plate 23 is slightly larger than zero degrees. Zero degrees refers to the angle of the swash plate's inclination when it is perpendicular to the axis of the drive shaft 18. Therefore, even if the inclination of the swash plate 23 is minimum, refrigerant gas in the compression chambers 113 is discharged to the discharge chamber 132 and the compressor operates at the minimum displacement. The refrigerant gas discharged to the discharge chamber 132 from the compression chambers 113 is drawn into the crank chamber 121 through the supply passage 41. The refrigerant gas in the crank chamber 121 is drawn back into the compression chambers 113 through the pressure release passage 40, a pressure release hole 301 and the suction chamber 131. That is, when the inclination of the swash plate 23 is minimum, refrigerant gas circulates within the compressor traveling through the discharge chamber 132, the supply passage 41, the crank chamber 121, the pressure release passage 40, the pressure release hole 301, the suction chamber 131 and the compression chambers 113. This circulation of refrigerant gas allows the lubricant oil contained in the gas to lubricate each part in the compressor.

When the compressor is operated with the inclination of the swash plate 23 being minimum, an increase in cooling load increases the temperature of the evaporator 48. When the temperature of the evaporator 48 exceeds the frost forming temperature, the computer C excites the solenoid 43 in the electromagnetic valve 42 based on signals from the temperature sensor 49. When excited, the solenoid 43 causes the valve body 44 to close the valve hole 421. This stops the flow of refrigerant gas in the discharge chamber 132 into the crank chamber 121. Refrigerant gas in the crank chamber 121 flows into the suction chamber 131 via the pressure release passage 40 and the pressure release hole 301. This results in a pressure decrease in the crank chamber 121, thereby moving the swash plate 23 from the minimum inclination toward the maximum inclination.

As the swash plate's inclination increases, the force of the spring 31 gradually pushes the shutter 30 away from the positioning surface 35. This gradually enlarges the cross-sectional area of gas flow from the suction passage 34 to the suction chamber 131. Accordingly, the amount of refrigerant gas flow from the suction passage 34 into the suction chamber 131 gradually increases. Therefore, the amount of refrigerant gas that is drawn into the compression chambers 113 from the suction chamber 131 gradually increases. The displacement of the compressor gradually increases, accordingly. The discharge pressure of the compressor gradually increases and the torque necessary for operating the compressor also gradually increases. In this manner, the torque of the compressor does not significantly change in a short time. The shock that accompanies load torque fluctuations is thus lessened.

If the engine E is stopped, the compressor is also stopped (that is, the rotation of the swash plate 23 is stopped) and the solenoid 43 in the control valve 42 is de-excited. In this state, the inclination of the swash plate 23 is minimum. If the nonoperational state of the compressor continues, the pressures in the chambers of the compressor become equalized and the swash plate 23 is kept at the minimum inclination by the force of spring 28. Therefore, when the engine E is started again, the compressor starts operating with the swash plate at the minimum inclination. This requires the minimum torque. This reduces the shock caused by starting the compressor.

During operation, sliding parts of the piston 37 and the cylinder bores 111 abrade one another. This often generates foreign matter such as metal powder. Such foreign matter is discharged to the discharge chamber 132 from each compression chamber 113 with refrigerant gas. Some of the foreign matter enters and often gets caught between the proximal or radially inner ends of the discharge valve flaps 161 and the valve plate 14. This deteriorates the seal between the discharge valve flaps 161 and the valve plate 14, thereby affecting the compression efficiency of the compressor.

However, in the above described first embodiment, the foreign matter enters the groove 144 arranged facing the proximal end of each discharge valve flap 161 through the space between each discharge valve flap 161 and the valve plate 14. This prevents the foreign matter from getting caught between the proximal ends of the valve flaps 161 and the valve plate 14, thereby improving the seal between each discharge valve flap 161 and the valve plate 14.

To maintain the strength of the valve plate 14, the groove 144 is shallow. However, if foreign matter overfills the shallow groove 144 beyond the level of the valve plate 14, the foreign matter will push against the discharge valve flaps 161. In the first embodiment of the present invention, the groove 144 has an annular shape and extends laterally with respect to each discharge valve flap 161. In other words, the groove 144 extends circumferentially to the sides of each valve flap 161. Therefore, foreign matter that enters the groove 144 is guided along the groove 144 and then out of the groove 144 at another location such as 144A (FIG. 2) by the flow of refrigerant gas generated by the compressor's operation. The groove 144 is not covered by second plate 16 at the location 144A, and therefore foreign matter may exit the groove 144 where it does no harm. This prevents the foreign matter from remaining in the groove 144.

The single groove 144 corresponds to all the discharge valve flaps 161. This eliminates the need for separate grooves for each discharge valve flap 161. This simplifies formation of the groove 144.

Japanese Unexamined Patent Publication No. 3-255279 discloses a compressor having grooves formed on the valve plate in the area facing the proximal end of each reed valve. However, this publication does not mention foreign matter being caught between the valves and the plates. Further, in the compressor according to this publication a plurality of grooves are formed to correspond to each reed valve.

Foreign matter such as metal powder is apt to be generated especially at the sliding part of each piston 37 and the cooperating cylinder bore 111. The foreign matter generated is discharged to the discharge chamber 132 from each compression chamber 113 with the refrigerant gas. Therefore, the foreign matter is apt to get caught in the space between each discharge valve flap 161 and the valve plate 14. The above described first embodiment has a groove 144 formed opposite to the discharge valve flaps 161. This structure is efficient for preventing sealing defects between the discharge valve flaps 161 and the valve plate 14.

When the inclination of the swash plate 23 increases from the minimum inclination, in other words, when the discharge displacement of the compressor increases from the minimum displacement, effective compression is important. Effective compression here refers to an operation in which refrigerant gas in the compression chambers 113 is discharged to the discharge chamber 132 without backflow of the gas from the discharge chamber 132 to the compression chambers 113. In the above described first embodiment, the groove 144 prevents sealing defects between each discharge valve flap 161 and the valve plate 14. This allows the compressor to perform effective compression with the minimum inclination of the swash plate 23, thereby ensuring an increase in the compressor's displacement.

Figure 7:
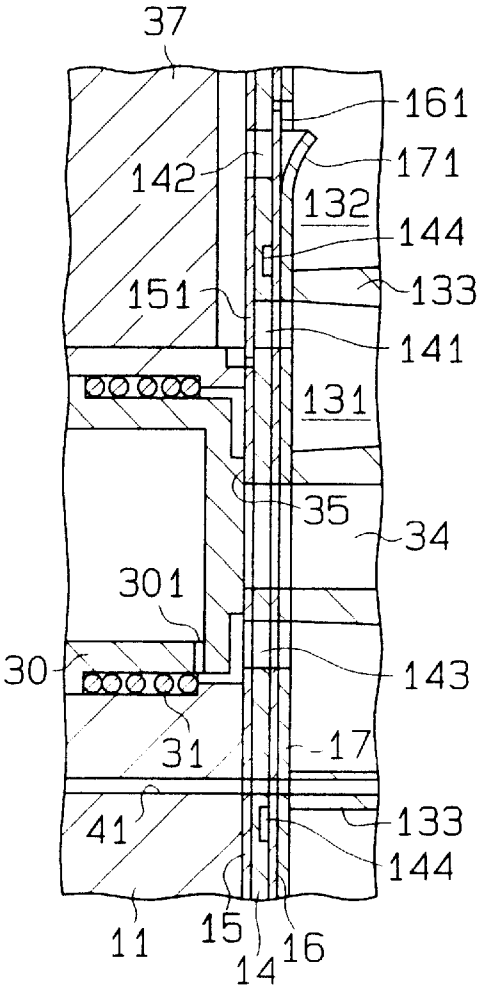
FIG. 7 is an enlarged partial cross-sectional side view taken along line 7—7 of FIG. 6.
Figure 6:
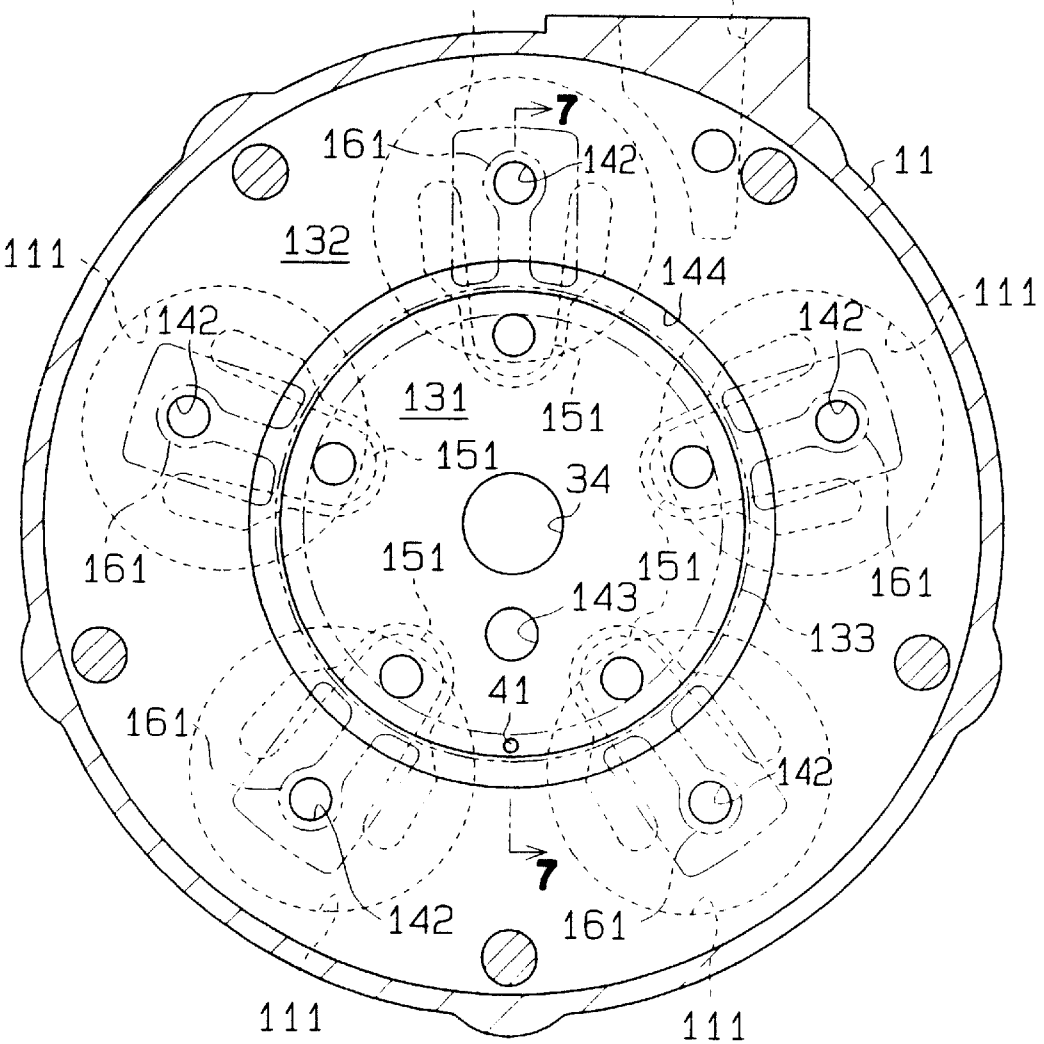
FIG. 6 is a cross-sectional front view similar to FIG. 2, but illustrating a compressor according to a second embodiment of the present invention.

A second embodiment of the present invention will now be described with reference to FIGS. 6 to 7. Like or the same reference numerals are given to those components that are like or the same as the corresponding components of the first embodiment.

An annular groove 144 according to the second embodiment is formed such that a part of the groove 144 is axially aligned with the bulkhead 133, which holds the second plate against the valve plate 14.

Each discharge valve flap 161 is flexible except for the part held by the bulkhead 133. Therefore, foreign matter enters the area radially outward of the part held by the bulkhead 133 between the discharge valve flaps 161 and the valve plate 14. Part of the groove 144, according to the embodiment of FIGS. 6 and 7, is axially aligned with the bulkhead 133. This prevents the foreign matter from getting caught between the flexing part of each discharge valve flap 161 and the valve plate 14. Accordingly, sealing defects between the discharge valve flaps 161 and the valve plate 14 are prevented.

In the compressor according to the above cited Japanese Unexamined Patent Publication No. 3-255279, the grooves are formed offset from the area held by components for holding the reed valves.

Figure 8:
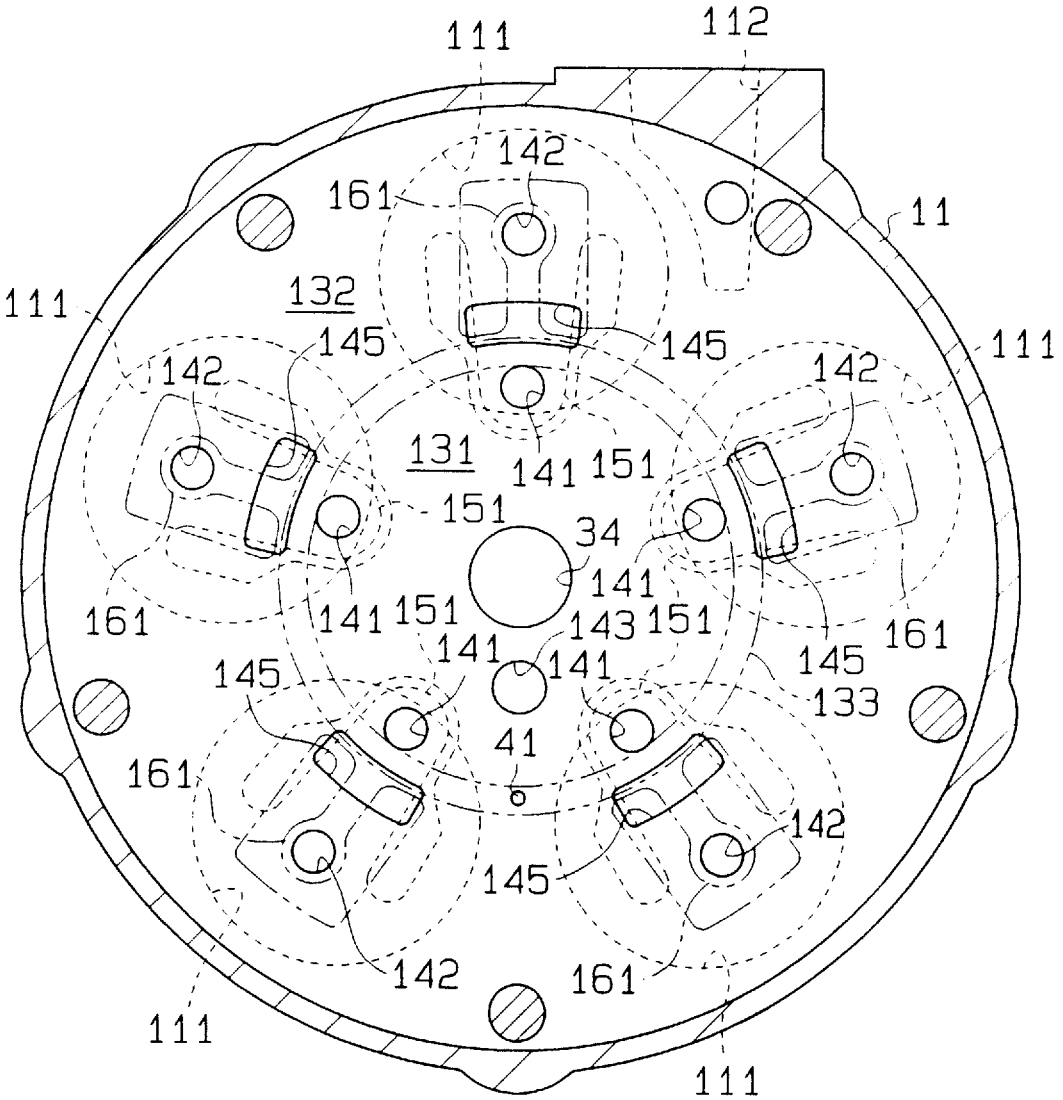
FIG. 8 is a cross-sectional front view similar to FIGS. 2 and 6, but illustrating a compressor according to a third embodiment of the present invention.

A third embodiment of the present invention will now be described with reference to FIG. 8. Like or the same reference numerals are given to those components that are like or the same as the corresponding components of the first embodiment.

In the third embodiment, a plurality of grooves 145 are formed on the valve plate 14. Each groove 145 corresponds to one of the discharge valve flaps 161 and is wider than the proximal end of the valve flap 161. Each groove 145 extends circumferentially with respect to the corresponding discharge valve flap's proximal end such that the ends of the groove 145 are spaced from the sides of the discharge valve's proximal end. Each groove 145 according to the third embodiment is formed such that a part of the groove 145 is aligned with the end of the bulkhead 133 in the axial direction of the compressor.

The grooves 145 according to the third embodiment prevent foreign matter from getting caught between the proximal end of each discharge valve flap 161 and the valve plate 14 as in the case of the groove 144 according to the first and second embodiments. Further, both ends of each groove 145 are laterally spaced from the corresponding discharge valve flap 161. This allows the foreign matter in the groove 145 to be removed by the flow of refrigerant gas generated by the compressor's operation, thereby preventing the foreign matter from remaining in the grooves 145. A part of each groove 145 is axially aligned with the bulkhead 133. This prevents foreign matter from getting caught between the flexing part of each discharge valve flap 161 and the valve plate 14.

In the third embodiment, the grooves 145 may be formed radially offset from and radially adjacent to the bulkhead 133 like the groove 144 of the embodiment of FIG. 1.

Figure 9:
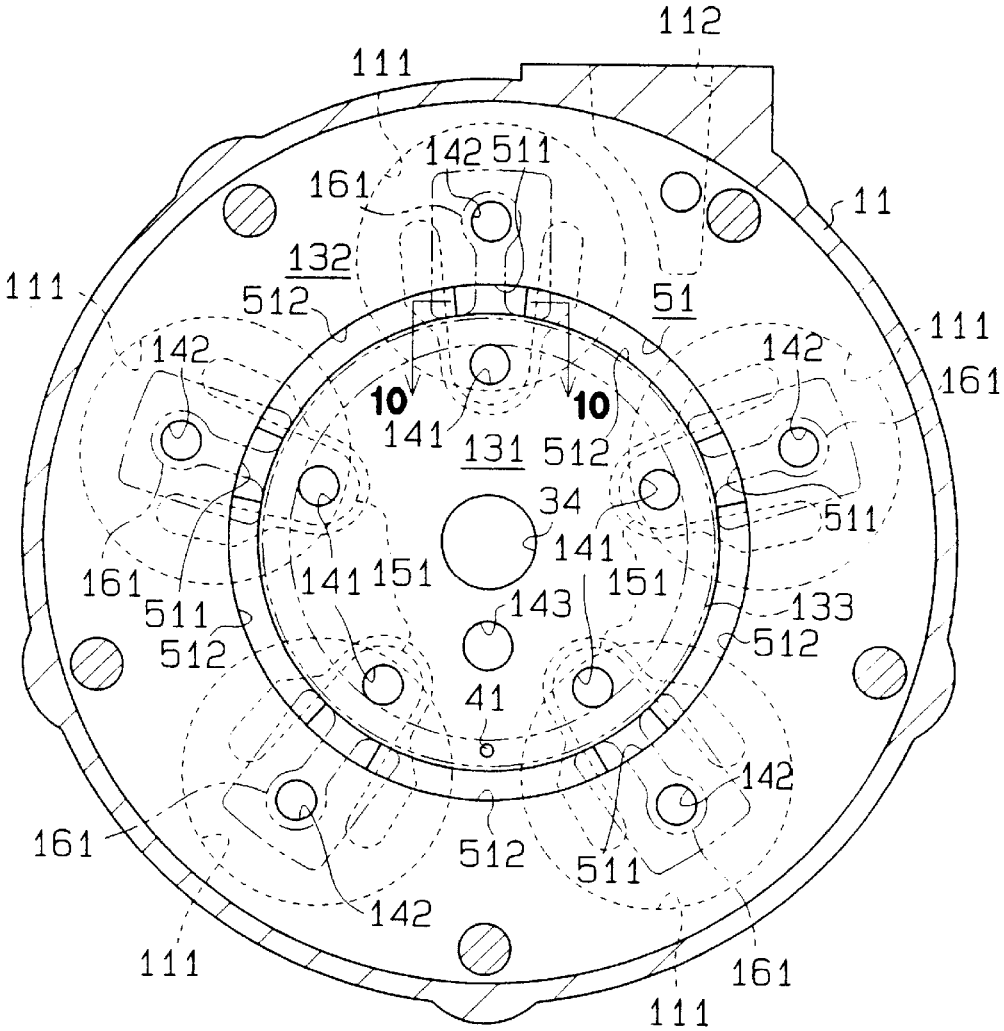
FIG. 9 is a cross-sectional front view similar to FIGS. 2, 6, or 8, but illustrating a compressor according to a fourth embodiment of the present invention.
Figure 10:
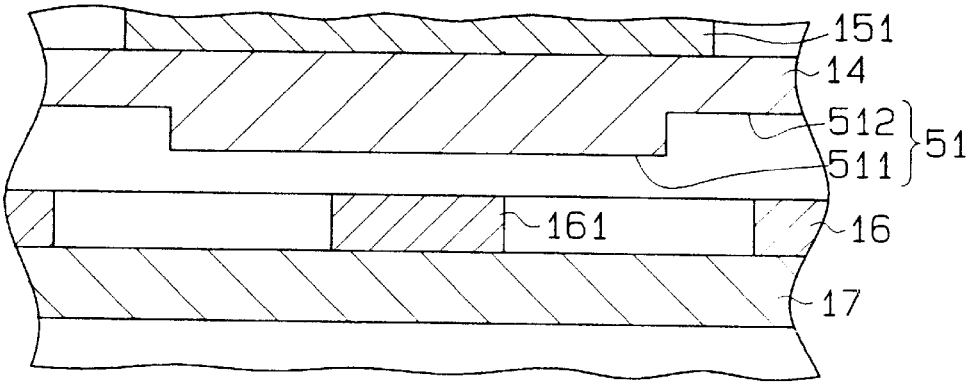
FIG. 10 is an enlarged partial cross-sectional view taken along line 10—10 of FIG. 9.

A fourth embodiment of the present invention will now be described with reference to FIGS. 9 and 10. Like or the same reference numerals are given to those components that are like or the same as the corresponding components of the first embodiment.

An annular groove 51 according to the fourth embodiment includes shallow portions 511 and deep portions 512. Each shallow portion 511 is arranged to face the discharge valve flaps 161. Foreign matter that enters the shallow portion 511 is readily carried to the deep portion 512. This prevents the foreign matter from remaining in the shallow portion 511.

A fifth embodiment of the present invention will now be described with reference to FIG. 11. Like or the same reference numerals are given to those components that are like or the same as the corresponding components of the first embodiment.

Figure 11:
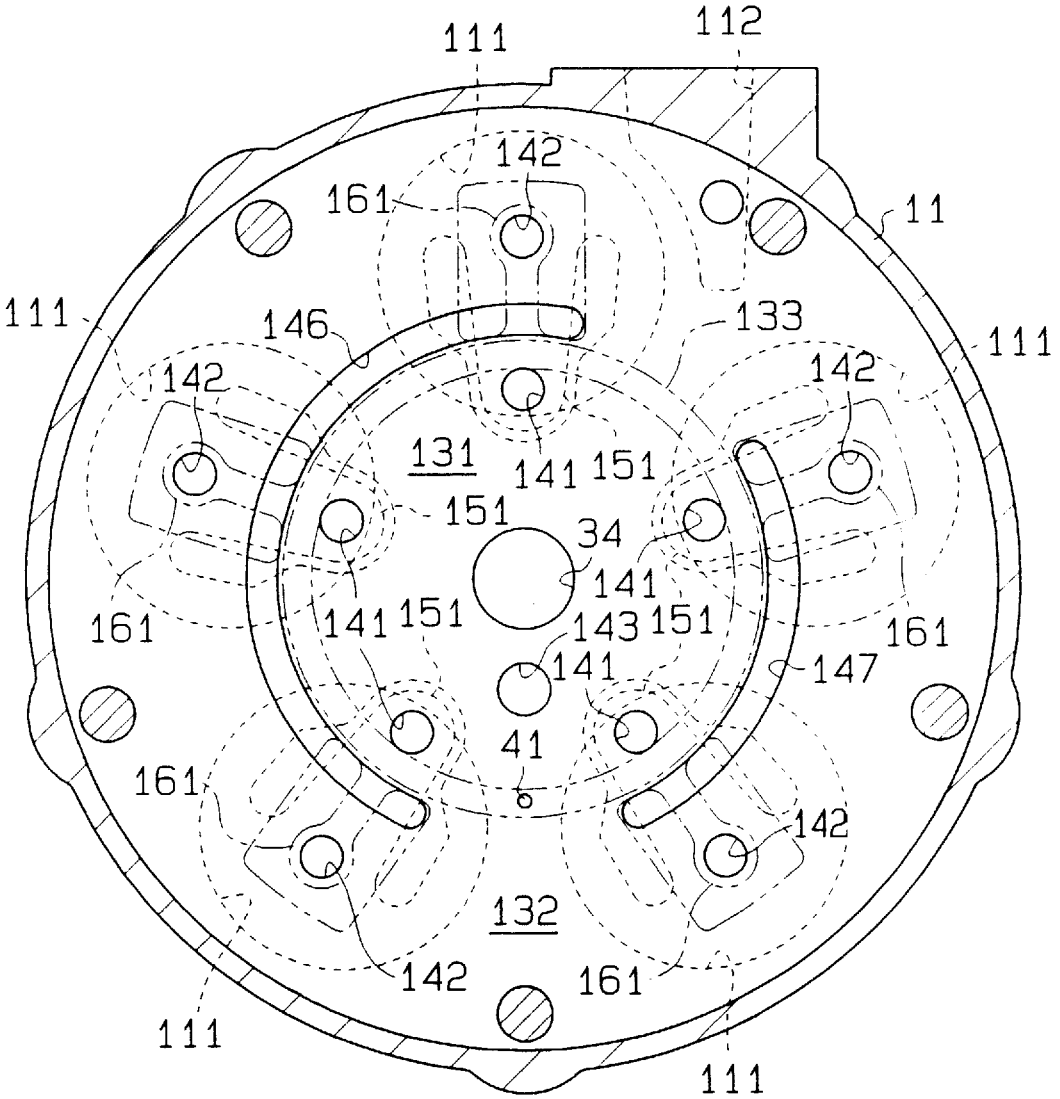
FIG. 11 is a cross-sectional front view similar to any of FIGS. 2, 6, 8, or 9, but illustrating a compressor according to a fifth embodiment of the present invention.

The compressor according to FIG. 11 has an arcuate circular first groove 146 that corresponds to three of the discharge valve flaps 161 and an arcuate circular second groove 147 that corresponds to the other two discharge valve flaps 161. Part of the grooves 146, 147 face the discharge valve flaps 161 and part is offset from the valve flaps 161. This structure prevents foreign matter from remaining in the grooves 146, 147. Each groove 146, 147 corresponds to a plurality of the discharge valve flaps 161. This structure facilitates formating of the grooves 146, 147.

Figure 12:
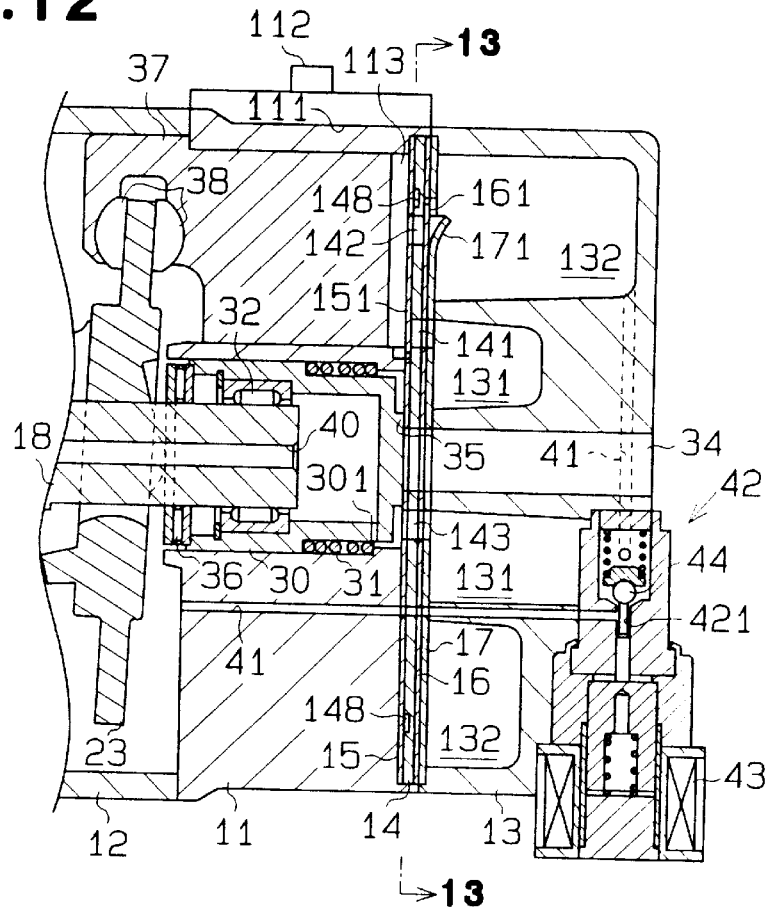
FIG. 12 is a partial cross-sectional side view illustrating a compressor according to a sixth embodiment of the present invention.
Figure 13:
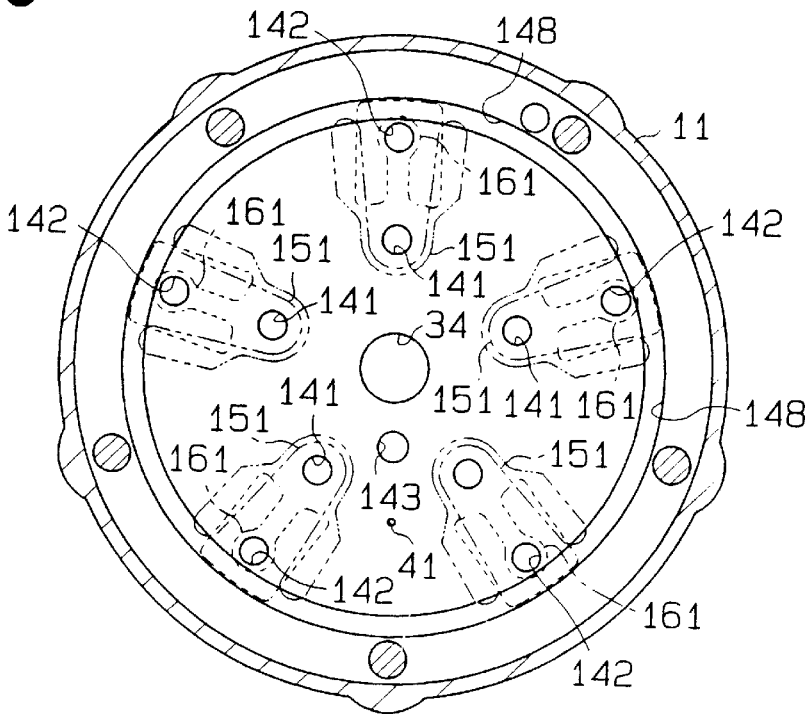
FIG. 13 is a cross-sectional view taken along 13—13 of FIG. 12.

A sixth embodiment of the present invention will now be described with reference to FIGS. 12 and 13. Like or the same reference numerals are given to those components that are like or the same as the corresponding components of the first embodiment.

An annular groove 148 according to the sixth embodiment is formed on a surface of the valve plate 14 that faces the suction valve flap 151. The groove 148 extends circumferentially, or laterally, with respect to the proximal end of each suction valve plate 151 and faces the proximal, or radially outward, end of each suction valve 151.

Foreign matter caught between the proximal end of each suction valve flap 151 and the valve plate 14 deteriorates the sealing between the suction valve flap 151 and the valve plate 14. This affects the compression efficiency of the compressor. In the compressor of FIG. 12, foreign matter between the suction valve's proximal end and the valve plate 14 is drawn into the groove 148. This prevents the foreign matter from getting caught between the proximal end of each suction valve flap 151 and the valve plate 14.

Figure 14:
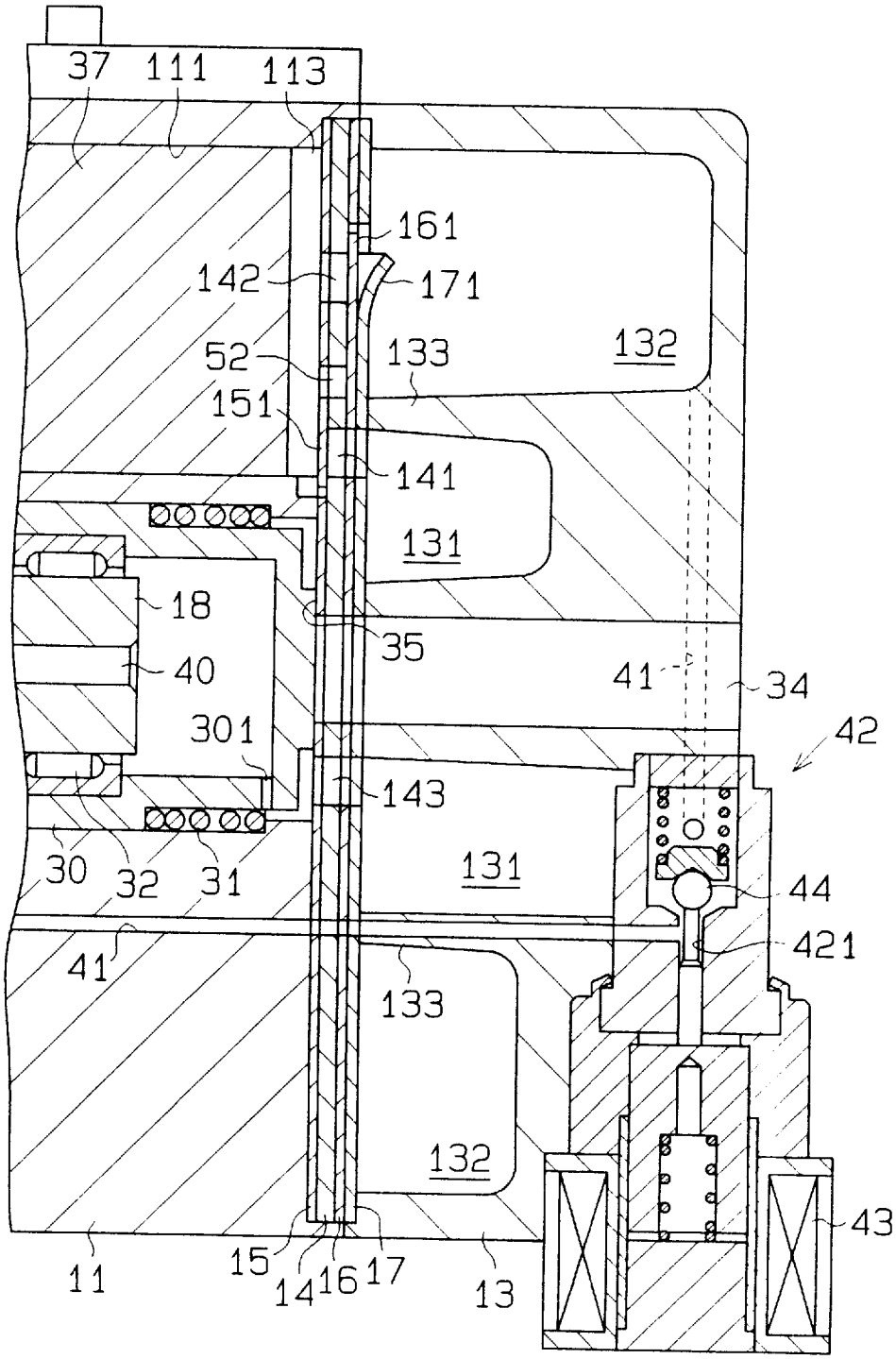
FIG. 14 is a partial cross-sectional side view illustrating a compressor according to a seventh embodiment of the present invention.
Figure 2:
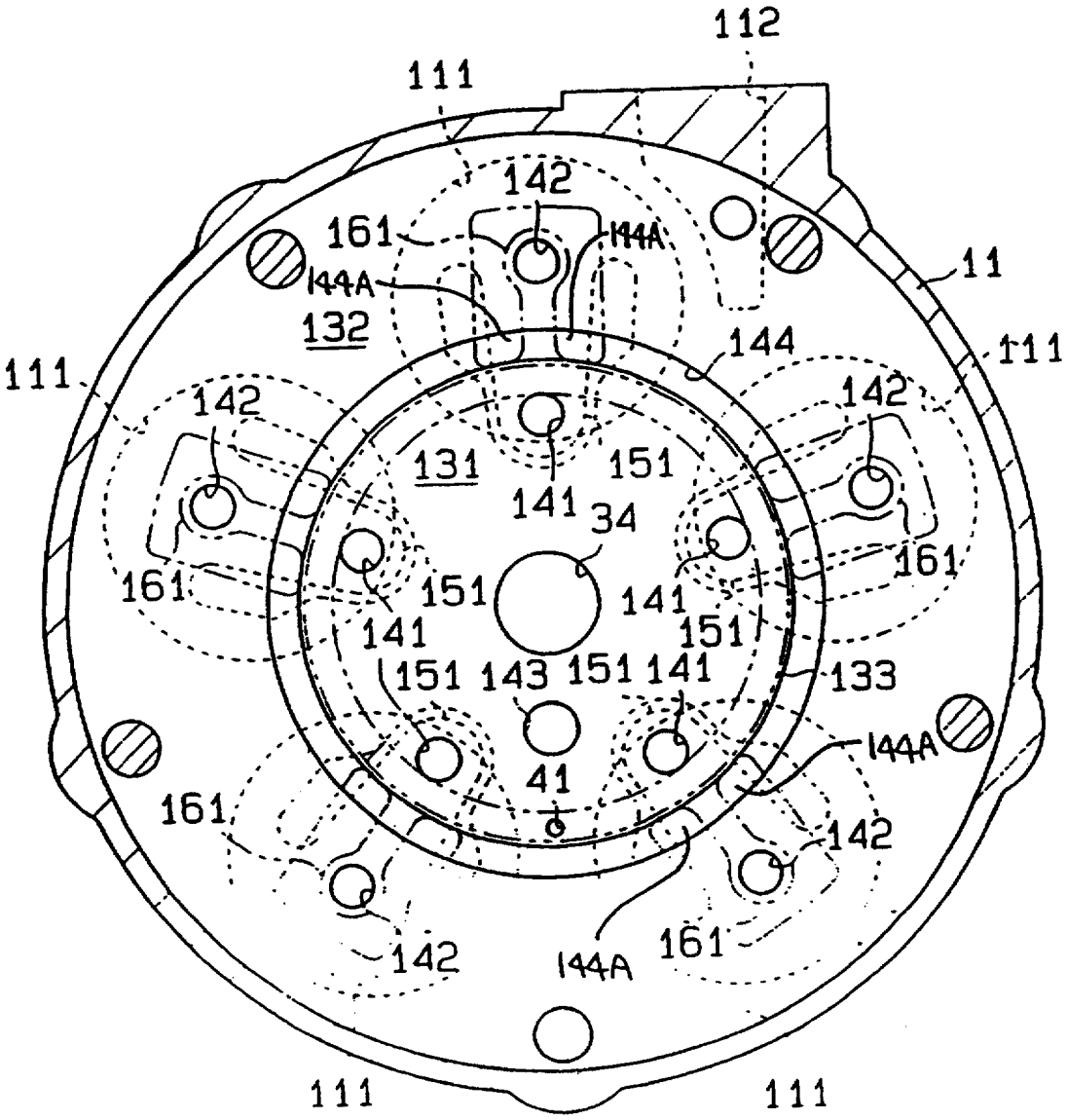

A seventh embodiment of the present invention will now be described with reference to FIG. 14. Like or the same reference numerals are given to those components that are like or the same as the corresponding components of the first embodiment.

In the seventh embodiment, a plurality of through holes 52 are formed in the valve plate 14 and the first plate 15. Each hole 52 is formed facing the proximal end of the corresponding discharge valve flap 161, immediately adjacent to a location on the valve plate 14 where the proximal end of the valve flap 161 is supported on the valve plate. When the refrigerant gas in each compression chamber 113 is discharged to the discharge chamber 132, the corresponding discharge valve flap 161 is opened, allowing the hole 52 to communicate the compression chamber 113 and the discharge chamber 132. When the refrigerant gas in the suction chamber 131 is drawn into each compression chamber 113, the corresponding hole 52 is closed by the discharge valve flap 161.

When a discharge valve flap 161 opens the corresponding discharge port 142, the corresponding port 52 is also opened. This permits the refrigerant gas in the compression chamber 113 to be discharged to the discharge chamber 132 through the hole 52, as well as through the port 142. The gas flow through the hole 52 removes the foreign matter between each discharge valve flap 161 and the valve plate 14. This prevents foreign matter from getting caught between the proximal end of each discharge valve flap 161 and the valve plate 14.

The present invention may be adapted to the clutchless type variable displacement compressors disclosed in Japanese Unexamined Patent Publications No. 3-37378 and No. 7-286581. The present invention may also be adapted to piston type compressors using clutches.

Therefore, the present examples and embodiments are to be considered as illustrative and not restrictive and the invention is not to be limited to the details given herein but may modified within the scope of the appended claims.

What is claimed is:

1. A compressor comprising:

a plurality of compression chambers for compressing gas;

a gas chamber including one of a suction chamber for supplying the gas to the compression chambers and a discharge chamber for receiving the compressed gas from the compression chambers;

a plate member located between the compression chambers and the gas chamber;

said plate member having a plurality of ports respectively arranged in association with said compression chambers for connecting each compression chamber with the gas chamber;

a plurality of valve flaps respectively arranged in association with the ports, each of said valve flaps facing the plate member to selectively open and close the associated port, each valve flap having a proximal end supported on the plate member; and said plate member having groove means formed thereon and facing the proximal end of each valve flap wherein foreign matter entering between the proximal end of each valve flap and the plate member is collected by the groove means;

said groove means having a shallow portion facing each valve flap and a deep portion adjacent to the shallow portion, on each side of the shallow portion.

2. The compressor according to claim 1, wherein said groove means includes a single annular groove extending over all the valve flaps.

3. The compressor according to claim 1 further comprising an urging member for urging the proximal end of each valve flap toward one direction against the plate member, wherein said groove means is located out of alignment with the urging member with respect to the direction in which the proximal end of each valve flap is urged.

4. The compressor according to claim 1, wherein each of said ports is a discharge port connecting the associated compression chamber with the discharge chamber, and wherein each of said valve flaps is a discharge valve flap selectively opening and closing the associated discharge port.

5. The compressor according to claim 1, wherein each of said ports is a suction port connecting the associated compression chamber with the suction chamber, and wherein each of said valve flaps is a suction valve flap selectively opening and closing the associated suction port.

6. The compressor according to claim 1 further comprising:

an external circuit connecting the discharge chamber and the suction chamber;

a crank chamber;

a drive shaft extending through the crank chamber;

a cam plate mounted on the drive shaft in the crank chamber;

a plurality of cylinder bores;

a plurality of pistons operably coupled to the cam plate and respectively located in the cylinder bores, wherein each of said compression chambers is defined in each cylinder bore between the piston and the plate member, wherein said cam plate converts rotation of the drive shaft to reciprocating movement of each piston in the associated cylinder bore to vary the capacity of each compression chamber, each piston compressing gas supplied to the associated compression chamber from the external circuit by way of the suction chamber and discharging the compressed gas to the external circuit by way of the discharge chamber; and said cam plate being tiltable between a maximum inclined angle position and a minimum inclined angle position with respect to a plane perpendicular to an axis of the drive shaft according to a differential pressure between in the crank chamber and in the compression chambers, wherein each piston moves by the stroke based on an inclined angle of the cam plate to control the displacement of the compressor.

7. The compressor according to claim 6 further comprising a shutter member for disconnecting the external circuit from the suction chamber when the cam plate is in the minimum inclined angle position to minimize the displacement of the compressor.

8. The compressor according to claim 7 further comprising:

a supply passage for connecting the discharge chamber with the crank chamber to deliver the gas from the discharge chamber to the crank chamber;

a release passage for connecting the crank chamber with the suction chamber to deliver the gas from the crank chamber to the suction chamber; and a gas circulating passage including said supply passage and said release passage, said circulating passage being defined upon disconnection of the external circuit from the suction chamber.

9. The compressor according to claim 8 further comprising control means disposed midway on the supply passage for adjusting the amount of the gas introduced into the crank chamber from the discharge chamber through the supply passage to control the pressure in the crank chamber.

10. The compressor according to claim 7 further comprising an external driving source coupled directly to the drive shaft to operate the compressor.

11. The compressor according to claim 1 wherein the groove means extends beneath at least two valve flaps.

12. A compressor comprising:

a compression chamber for compressing gas;

a gas chamber including one of a suction chamber for supplying the gas to the compression chamber and a discharge chamber for receiving the compressed gas from the compression chamber;

a plate member located between the compression chamber and the gas chamber;

said plate member having a port for connecting the compression chamber with the gas chamber;

a valve flap facing the plate member to selectively open and close the port, said valve flap having a proximal end;

an urging member for urging the proximal end of the valve flap toward one direction against the plate member to support the proximal end on the plate member; and said plate member having groove means formed thereon and facing the proximal end of the valve flap, wherein foreign matter entering between the proximal end of the valve flap and the plate member is collected by the groove means, said groove means having a portion aligned with the urging member with respect to the direction in which the proximal end of the valve flap is urged.

13. The compressor according to claim 12, wherein said groove means has a portion extending out of a region facing the valve flap.

14. The compressor according to claim 13 further comprising:

a plurality of said compression chambers;

said plate member having a plurality of said ports respectively arranged in association with said compression chambers;

a plurality of said valve flaps respectively arranged in association with the ports; and said groove means extending over at least two valve flaps.

15. The compressor according to claim 14, wherein said groove means includes a single annular groove extending over all the valve flaps.

16. The compressor according to claim 13 further comprising:

an external circuit connecting the discharge chamber and the suction chamber;

a crank chamber;

a drive shaft extending through the crank chamber;

a cam plate mounted on the drive shaft in the crank chamber;

a plurality of cylinder bores;

a plurality of pistons operably coupled to the cam plate and respectively located in the cylinder bores, wherein said compression chamber is defined in each cylinder bore between the piston and the plate member, wherein said cam plate converts rotation of the drive shaft to reciprocating movement of each piston in the associated cylinder bore to vary the capacity of each compression chamber, each piston compressing gas supplied to the associated compression chamber from the external circuit by way of the suction chamber and discharging the compressed gas to the external circuit by way of the discharge chamber; and said cam plate being tiltable between a maximum inclined angle position and a minimum inclined angle position with respect to a plane perpendicular to an axis of the drive shaft according to a differential pressure between in the crank chamber and in the compression chambers, wherein each piston moves by the stroke based on an inclined angle of the cam plate to control the displacement of the compressor.

17. The compressor according to claim 16 further comprising a shutter member for disconnecting the external circuit from the suction chamber when the cam plate is in the minimum inclined angle position to minimize the displacement of the compressor.

18. The compressor according to claim 17 further comprising:

a supply passage for connecting the discharge chamber with the crank chamber to deliver the gas from the discharge chamber to the crank chamber;

a release passage for connecting the crank chamber with the suction chamber to deliver the gas from the crank chamber to the suction chamber; and a gas circulating passage including said supply passage and said release passage, said circulating passage being defined upon disconnection of the external circuit from the suction chamber.

19. The compressor according to claim 17 further comprising an external driving source coupled directly to the drive shaft to operate the compressor.

20. A compressor comprising:

a compression chamber for compressing gas;

a gas chamber including one of a suction chamber for supplying the gas to the compression chamber and a discharge chamber for receiving the compressed gas from the compression chamber;

a plate member located between the compression chamber and the gas chamber;

said plate member having a port for connecting the compression chamber with the gas chamber;

a valve flap facing the plate member to selectively open and close the port, said valve flap having a proximal end supported on the plate member and a distal, unsupported end, wherein the port faces the distal end; and said plate member having a through-hole facing the proximal end of the valve flap, said through-hole being immediately adjacent to a location on the plate member where the proximal end of the valve is supported on the plate member, wherein said through:hole is closed by the proximal end of the valve flap when the distal end of the valve flap closes the port, and wherein said through-hole connects the compression chamber with the gas chamber so that the gas flow through the hole removes foreign matter between the proximal end of the valve flap and the plate member when the valve flap opens the port.

21. The compressor according to claim 20 further comprising:

an external circuit connecting the discharge chamber and the suction chamber;

a crank chamber;

a drive shaft extending through the crank chamber;

a cam plate mounted on the drive shaft in the crank chamber;

a plurality of cylinder bores;

a plurality of pistons operably coupled to the cam plate and respectively located in the cylinder bores, wherein said compression chamber is defined in each cylinder bore between the piston and the plate member, wherein said cam plate converts rotation of the drive shaft to reciprocating movement of each piston in the associated cylinder bore to vary the capacity of each compression chamber, each piston compressing gas supplied to the associated compression chamber from the external circuit by way of the suction chamber and discharging the compressed gas to the external circuit by way of the discharge chamber; and said cam plate being tiltable between a maximum inclined angle position and a minimum inclined angle position with respect to a plane perpendicular to an axis of the drive shaft according to a differential pressure between in the crank chamber and in the compression chambers, wherein each piston moves by the stroke based on an inclined angle of the cam plate to control the displacement of the compressor.

22. The compressor according to claim 21 further comprising a shutter member for disconnecting the external circuit from the suction chamber when the cam plate is in the minimum inclined angle position to minimize the displacement of the compressor.

23. The compressor according to claim 22 further comprising:

a supply passage for connecting the discharge chamber with the crank chamber to deliver the gas from the discharge chamber to the crank chamber;

a release passage for connecting the crank chamber with the suction chamber to deliver the gas from the crank chamber to the suction chamber; and a gas circulating passage including said supply passage and said release passage, said circulating passage being defined upon disconnection of the external circuit from the suction chamber.

24. The compressor according to claim 22 further comprising an external driving source coupled directly to the drive shaft to operate the compressor.

25. The compressor of claim 20 wherein the port is larger than the through-hole.

26. A compressor comprising:

a housing;

a plurality of compression chambers defined in the housing for compressing gas;

a gas chamber defined in the housing, the gas chamber including one of a suction chamber for supplying the gas to the compression chambers and a discharge chamber for receiving the compressed gas from the compression chambers;

a plate member located between the compression chambers and the gas chamber;

said plate member having a plurality of ports respectively arranged in association with said compression chambers for connecting each compression chamber with the gas chamber;

a plurality of valve flaps respectively arranged in association with the ports, each of said valve flaps facing the plate member to selectively open and close the associated port, each valve flap having a proximal end supported on the plate member and a distal, unsupported end, wherein each port faces said distal end of a respective valve flap;

said housing comprising a wall member having an interior surface defining in part said gas chamber, said wall member bearing against said proximal ends of each of said valve flaps for securing said proximal ends to said plate member; and said plate member having groove means formed thereon and facing the proximal end of each valve flap, said groove means defined in part by a proximal wall aligned with said wall member interior surface and a distal wall, said distal wall being between said proximal wall and the associated port, wherein foreign matter entering between the proximal end of each valve flap and the plate member is collected by the groove means.

27. The compressor according to claim 26, wherein the groove means extends beneath at least two valve flaps.

28. A compressor comprising:

a compression chamber for compressing gas;

a gas chamber including one of a suction chamber for supplying the gas to the compression chamber and a discharge chamber for receiving the compressed gas from the compression chamber;

a plate member located between the compression chamber and the gas chamber;

said plate member having a port for connecting the compression chamber with the gas chamber;

a valve flap facing the plate member to selectively open and close the port, said valve flap having a proximal end supported on the plate member and having a normally closed position in engagement with the plate member, thereby closing the port; and said plate member having a through-hole facing the proximal end of the valve flap, wherein said through-hole is closed by the proximal end of the valve flap when the valve flap closes the port, and said through-hole connects the compression chamber with the gas chamber so that the gas flow through the hole removes foreign matter between the proximal end of the valve flap and the plate member when the valve flap opens the port.

* * * * *

UNITED STATES PATENT AND TRADEMARK OFFICE

CERTIFICATE OF CORRECTION

PATENT NO. : 5,890,878

DATED : April 6, 1999

INVENTOR(S) : Masakazu Murase, et al.

It is certified that error appears in the above-identified patent and that said Letters Patent is hereby corrected as shown below:

Column 1, line 5, change "valve" to ---valves--;

Signed and Sealed this

Twenty-second Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,890,878
DATED : April 6, 1999
INVENTOR(S) : Masakazu Murase, et al.

It is certified that error appears in the above-identified patent and that said Letters Patent is hereby corrected as shown below:

Correct Figure 2 to include reference numerals 144A (four occurrences), as shown on the attached copy of figure 2.

Signed and Sealed this

Seventh Day of August, 2001

*Attest:*

Nicholas P. Godici

NICHOLAS P. GODICI
*Acting Director of the United States Patent and Trademark Office*

*Attesting Officer*